US005697028A

United States Patent [19]

Kobayashi et al.

[11] Patent Number: 5,697,028

[45] Date of Patent: Dec. 9, 1997

[54] DEVELOPER-SUPPLYING ROLLER HAVING A SURFACE-MODIFYING POWDER

[75] Inventors: Tetsuya Kobayashi; Hiroshi Sasame, both of Numazu; Tatsuhiko Hayakawa, Mishima; Naoki Enomoto, Susono; Yoshiro Saito, Numazu, all of Japan

[73] Assignee: Canon Kabushiki Kaisha, Tokyo, Japan

[21] Appl. No.: 575,130

[22] Filed: Dec. 19, 1995

[30] Foreign Application Priority Data

Dec. 21, 1994 [JP] Japan ..... 6-318287
May 23, 1995 [JP] Japan ..... 7-123902

[51] Int. Cl.[6] ..... G03G 15/08

[52] U.S. Cl. ..... 399/281

[58] Field of Search ..... 355/245, 251, 355/253, 259; 118/656, 657, 658; 399/252, 272, 281

[56] References Cited

U.S. PATENT DOCUMENTS 4,505,573 3/1985 Brewington et al. ..... 355/259
4,930,438 6/1990 Demizu et al. ..... 355/259 X
5,235,386 8/1993 Yano et al. ..... 355/219
5,287,150 2/1994 Kinoshita et al. ..... 355/259
5,307,127 4/1994 Kobayashi et al. ..... 355/259
5,321,482 6/1994 Yano et al. ..... 355/299

FOREIGN PATENT DOCUMENTS 50-93437 9/1975 Japan .

*Primary Examiner*—Nestor R. Ramirez
*Attorney, Agent, or Firm*—Fitzpatrick, Cella, Harper & Scinto

[57] ABSTRACT

A developing apparatus is provided which includes a developing chamber for containing a developer, a developer-carrying member for carrying and conveying the developer to a developing region, and a developer-supplying member abutted rotatably to the developer-carrying member. The developer-supplying member has surface-modifying powder at least at its surface. The powder has substantially no chargeability or a chargeability of a polarity equal to that of the developer and a magnitude in terms of absolute value equal to or smaller than that of the developer. By application of the surface-modifying powder, the developing apparatus can obviate a partial tearing of a surface portion of the developer-supplying member which leads to image defects and an increase in drive torque at the initial drive thereof.

8 Claims, 7 Drawing Sheets

DEVELOPER-SUPPLYING ROLLER HAVING A SURFACE-MODIFYING POWDER

FIELD OF THE INVENTION AND RELATED ART

The present invention relates to a developing apparatus for developing an electrostatic image formed by electrophotography or electrostatic recording on an image-bearing member to form a visual image, particularly a developing apparatus capable of providing high-quality images by using a mono-component developer.

An image forming apparatus, such as a copier or a printer, operates according to either electrophotography or electrostatic recording, and includes a developing apparatus using a developer (or sometimes also called a toner). An example of developing apparatus used in an image forming apparatus according to electrophotography is illustrated in FIG. 8. Referring to FIG. 8, the developing apparatus includes a developing chamber 102 having an opening 103 at a position opposite to a photosensitive drum 101. Behind the developing chamber 102, a toner vessel 114 containing a toner therewithin is disposed. A partition wall 115 is disposed partitioning the developing chamber 102 and the vessel 114. The developing chamber 102 is equipped with a developing sleeve 110 as an electroconductive developer-carrying member disposed rotatably so as to expose a portion thereof out of the opening 103. In the developing operation, the developing sleeve 110 rotates in a direction of an indicated arrow to carry and convey the toner to the photosensitive drum 101.

The developing sleeve 110 is disposed with a spacing of 50–500 μm from the photosensitive drum 101 in a developing region, where the toner carried on the developing sleeve 110 is supplied to the photosensitive drum 101. The developing chamber 102 further houses a supply roller 112 for supplying the toner conveyed by a conveying means 111 from the toner vessel 114 to the developing sleeve 110.

In the developing operation, the developing sleeve 110 is supplied with a developing bias voltage comprising a DC voltage and an AC voltage in superposition from a bias power supply 106.

Above the developing sleeve 110 is disposed a blade 113 as a developer regulating member for controlling the toner layer thickness carried on the developing sleeve 110. The blade 113 is affixed to the developing chamber 102. Further, below the developing sleeve 110, a blowout prevention sheet 108 for preventing the toner from being blown out from the lower part of the developing chamber 102 to the outside is disposed.

In the developing operation, the conveying means 111 conveys the toner beyond the partition wall 115 to the supply roller 112, which is a developer-supplying member rotating in the indicated arrow direction, thereby applying the toner onto the developing sleeve 110. The provision of such a supply roller 112 is particularly required in case of using a non-magnetic toner containing no magnetic material, of which the conveyance to the developing sleeve 110 cannot be effected by utilizing a magnetic constraint force. The developing sleeve 110 rotates in the indicated arrow direction while carrying the toner in a prescribed layer thickness regulated by the blade 113 to the developing region opposing the photosensitive drum 101. In the developing region, an electric field is formed by a developing bias supplied from the bias power supply 106 to the developing sleeve 110 and, according to the electric field, the toner is caused to jump from the developing sleeve 110 to be attached onto a portion on the photosensitive drum 101 where an electrostatic latent image is formed to visualize the latent image.

In the above structure, the supply roller 112 preferably comprises a rubber foam material of polyurethane, silicone rubber, etc., and the supply roller 112 may preferably be rotated with a peripheral speed difference from the sleeve 110 while being abutted to the sleeve 110, in order to effect stable toner supply and uniform toner application onto the sleeve 110. The foam may be composed of either independent cells or communicating cells.

Before the operation of the developing apparatus, the toner is stored in the toner container and is started to be supplied to the developing chamber for the first time in use for development. Particularly, in the case of a developing apparatus contained in a process cartridge, i.e., an integral unit incorporating at least one of a charging means, a photosensitive drum and a cleaning means together with a developing apparatus so as to be releasably mountable to a main assembly of an image forming apparatus, such as a copier, a laser beam printer, a facsimile apparatus, etc., it is required that the toner is reliably contained in the toner container in order to avoid an inconvenience that the toner is flown out from the apparatus during the circulation of the process cartridge. Accordingly, prior to the operation of the developing apparatus, the supply roller is placed in a state of direct abutment to the developing sleeve. When the developing apparatus in this state is started, the supply roller is liable to cause a partial tearing of its outer surface portion due to rubbing with the developing sleeve, and the torn fragment thereof is liable to move along with the rotation of the developing sleeve to the abutting portion between the developing sleeve and the developing blade to hinder the formation of a uniform toner layer, thus resulting in streaks in the resultant images. Further, the drive torque is liable to be increased promoting the fragment formation, thus being liable to cause more serious troubles, such as damage to the drive system of the developing apparatus or the drive system of the image forming apparatus.

SUMMARY OF THE INVENTION

Accordingly, an object of the present invention is to provide a developing apparatus capable of avoiding damage of a supply roller, image defects due to ununiform toner application, or damage of a developing apparatus drive system due to an increased drive torque of the developing apparatus.

Another object of the present invention is to provide a process cartridge incorporating such a developing apparatus and that is detachably mountable to a main assembly of an image forming apparatus.

According to the present invention, there is provided a developing apparatus, comprising: a developing chamber for containing a developer, a developer-carrying member for carrying and conveying the developer to a developing region, and a developer-supplying member abutted rotatably to the developer-carrying member; wherein said developer-supplying member has powder at least at its surface, said powder having substantially no chargeability or a chargeability of a polarity equal to that of the developer, and a magnitude in terms of an absolute value, equal to or smaller than that of the developer.

According to another aspect of the present invention, there is provided a process cartridge detachably mountable to a main assembly of an image forming apparatus and including at least the above-mentioned developing apparatus.

According to the developing apparatus of the present invention, the increase in initial drive torque of the developing apparatus can be prevented, and it becomes possible to avoid image defects due to partial tearing or breakage of the developer-supply member at the time of driving the developing apparatus.

Further, it becomes possible to improve the uniformity of toner coating on the sleeve and prevent the occurrence of reversal fog by using the surface-reforming powder having substantially no chargeability or a chargeability of a polarity equal to that of the developer and a magnitude in terms of an absolute value, equal to or smaller than that of the developer. Further, it has become possible to prevent an increase in torque at the time of initial use of a process cartridge.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

In the developing apparatus according to the present invention, powder is present between the developer-supplying member and the developer-carrying member, and the slidability or slippability between these members is improved. Accordingly, even if these members are rotated with a peripheral speed difference, the abutting portion of the developer-supplying member is not pulled by or supplied with an excessive shearing force from the developer-carrying member, so that the formation of a breakage fragment due to tearing can be prevented. Further, as the surface-modifying powder is set to have substantially no chargeability or a chargeability of a polarity equal to that of the developer and a magnitude in terms of an absolute value equal to or smaller than that of the developer, it is possible to prevent excessive charge of the developer at the time of initial use of the developer and prevent the transfer of the powder onto non-image parts of the photosensitive drum (so-called "reversal fog"). In contrast thereto, if the surface-modifying powder has a chargeability to a polarity opposite to that of the developer, the developer can be charged by friction with the powder in addition to the expected friction with the developer-carrying member and with the developer-regulating blade to be excessively charged. Further, even if the powder has a chargeability of an equal polarity to that of the developer, if the chargeability of the powder is excessively larger than that of the developer, the developer can be provided with a lower triboelectric charge or charged to an opposite polarity. In the former case, the transfer of the developer from the developer carrying member can be hindered to result in a lower image density. In the latter case, fog can be caused.

Herein, the surface-modifying powder may suitably have a chargeability up to 1.5 times that of the developer as a chargeability substantially equal to that of the developer.

The chargeabilities of toners and powders referred to herein are based on values measured in the following manner.

Figure 2:
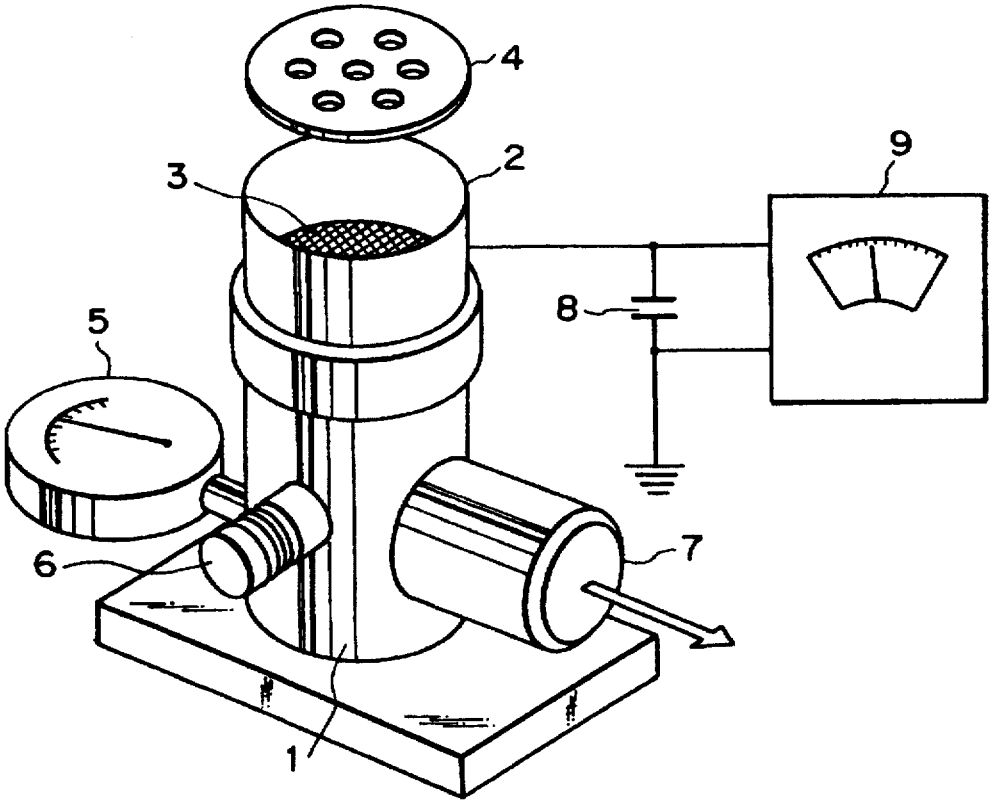
FIG. 2 is a schematic perspective view of an apparatus for measuring the chargeability of a powder sample.

FIG. 2 is an illustration of an apparatus for measuring a chargeability of a sample powder. A mixture of a sample powder and iron powder ("EFV 200/300, available from POWDER TECH CO.) is placed in a 50 ml-polyethylene bottle, and the bottle is shaken 500 times by hand. The mixture powder in an amount of ca. 0.5 g is placed in a metal-made measuring container 2 equipped with an electroconductive screen of 500 mesh at the bottom and covered with a metal lid 4. The total weight of the container 2 is weighed and denoted by $W_1$ (g). Then, an aspirator 1 composed of an insulating material at least with respect to a part contacting the container 2 is operated to suck the sample powder through a suction port 7 to set a pressure at a vacuum gauge 5 at 250 mmAq while adjusting an aspiration control valve 6. In this state, the aspiration is performed for at least 1 min. (preferably for ca. 2 min.) to remove the toner. The reading at this time of a potential meter 9 connected to the container 2 via a capacitor 8 having a capacitance C (μF) is measured and denoted by V (volts). The total weight of the container after the aspiration is measured and denoted by $W_2$ (g). Then, the triboelectric charge T (μC/g) of the sample powder is calculated according to the following formula:

$$T(\mu C/g)=(C\times V)/(W_1-W_2).$$

Figure 3:
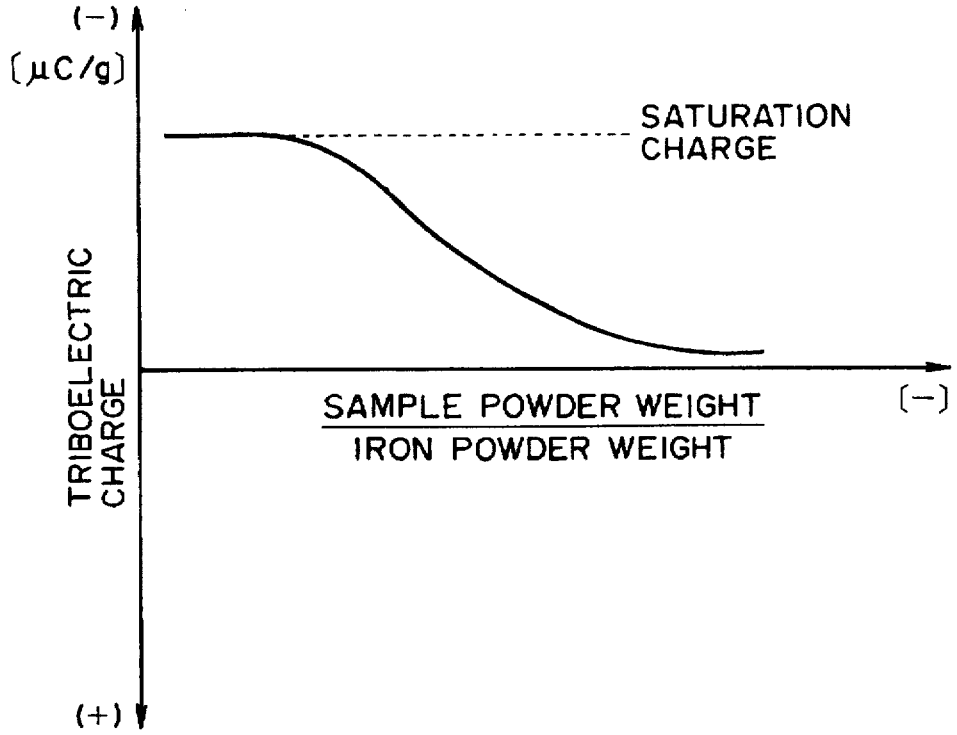
FIG. 3 is a graph showing a tendency of triboelectric charge increase of a powder.

The sample powder and the iron powder are left standing for at least 12 hours in an environment of 23° C. and 60% RH before the measurement. The mixture vibration and the charge measurement are also performed in the environment of 23° C. and 60% RH. Incidentally, the triboelectric charge of a sample powder depends on its content in a powder mixture with iron powder and reaches a saturation charge as the iron powder content in the mixture is increased as shown in FIG. 3. The saturation charge is taken as a chargeability of a sample powder referred to herein. FIG. 3 shows a characteristic curve in case of a sample powder showing a negative chargeability. In case of a sample showing a positive chargeability, the resultant curve is depicted on a (+) side (a lower-side in FIG. 3).

The surface-modifying powder applied onto the supply roller may preferably have a particle size providing a good slidability between the supply roller and the developing sleeve. More specifically, the powder may preferably have a particle size substantially equal to that of a toner to be used in combination or at least 1/100 of the latter. The particle size may be appropriately evaluated in terms of a volume-average particle size measured in the following manner.

A Coulter counter ("Model TA-II", available from Coulter Electronics Inc.) is used as an instrument for the measurement, to which an interface (available from Nikkaki K. K.) for providing a volume-basis distribution and a personal computer ("CX-1", available from Canon K.K.) are connected.

For measurement, a 1%-NaCl aqueous solution as an electrolyte solution is prepared by using a reagent-grade sodium chloride. To 100 to 150 ml of the electrolyte solution, 0.1 to 5 ml of a surfactant, preferably an alkylbenzenesulfonic acid salt, is added as a dispersant, and 0.5–50 mg of a sample powder is added thereto. The resultant dispersion of the sample in the electrolyte liquid is subjected to a dispersion treatment for about 1–3 minutes by means of an ultrasonic disperser, and then subjected to measurement of a volume-average particle size using the Coulter counter.

(First embodiment)

Figure 1:
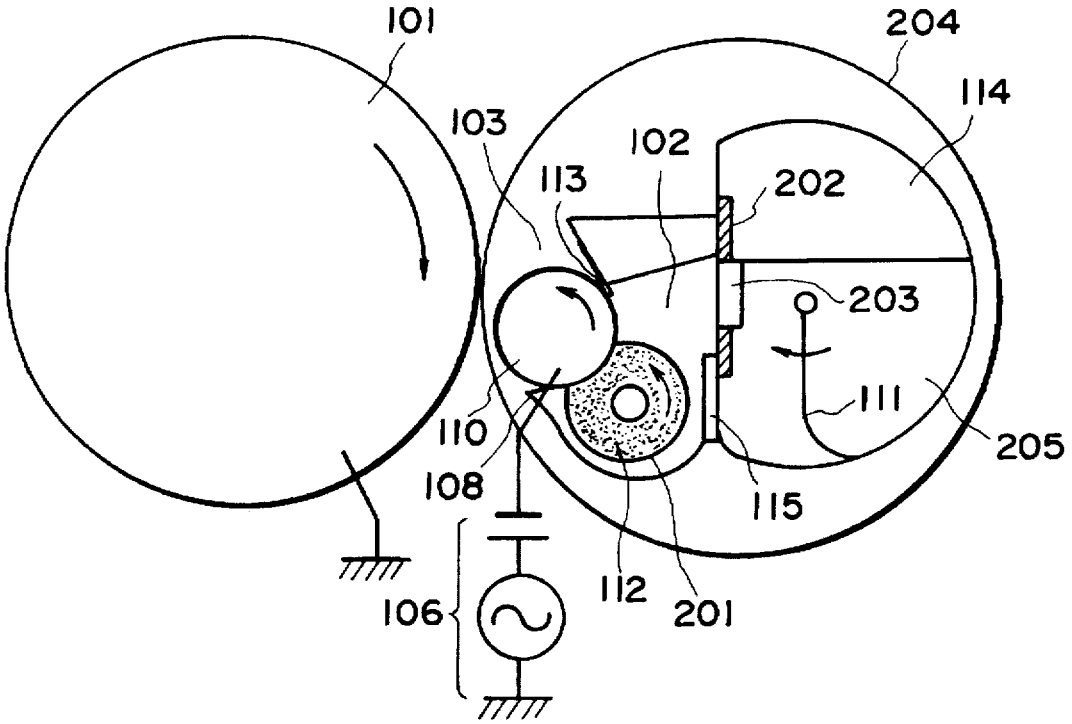
FIG. 1 is an illustration of a first embodiment of the developing apparatus according to the invention.
Figure 8:
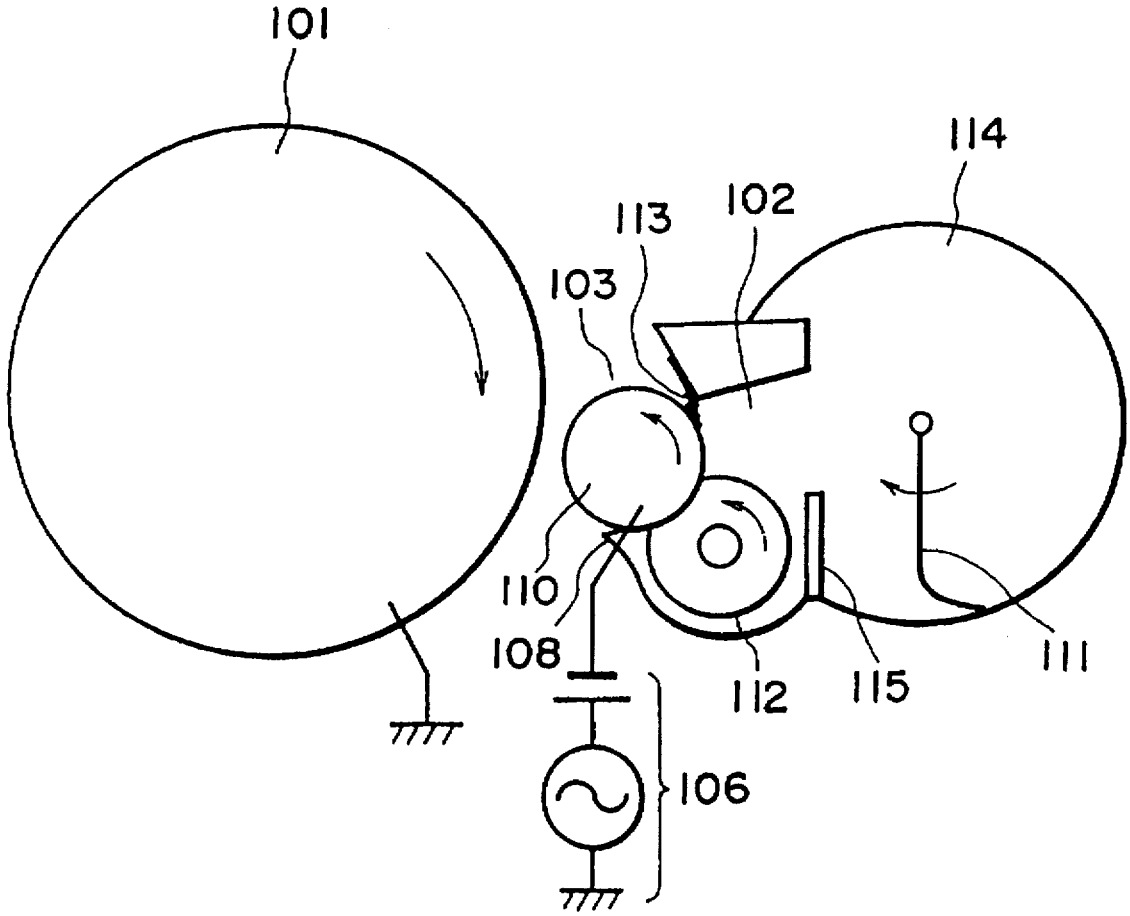
FIG. 8 PRIOR ART
FIG. 8 is an illustration of an image forming apparatus according to the prior art.

FIG. 1 shows a first embodiment of the developing apparatus according to the present invention as an enlarged view around the developing sleeve, wherein parts similar to those shown in FIG. 8 are denoted by identical reference numerals and detailed description thereof may be omitted.

Figure 9:
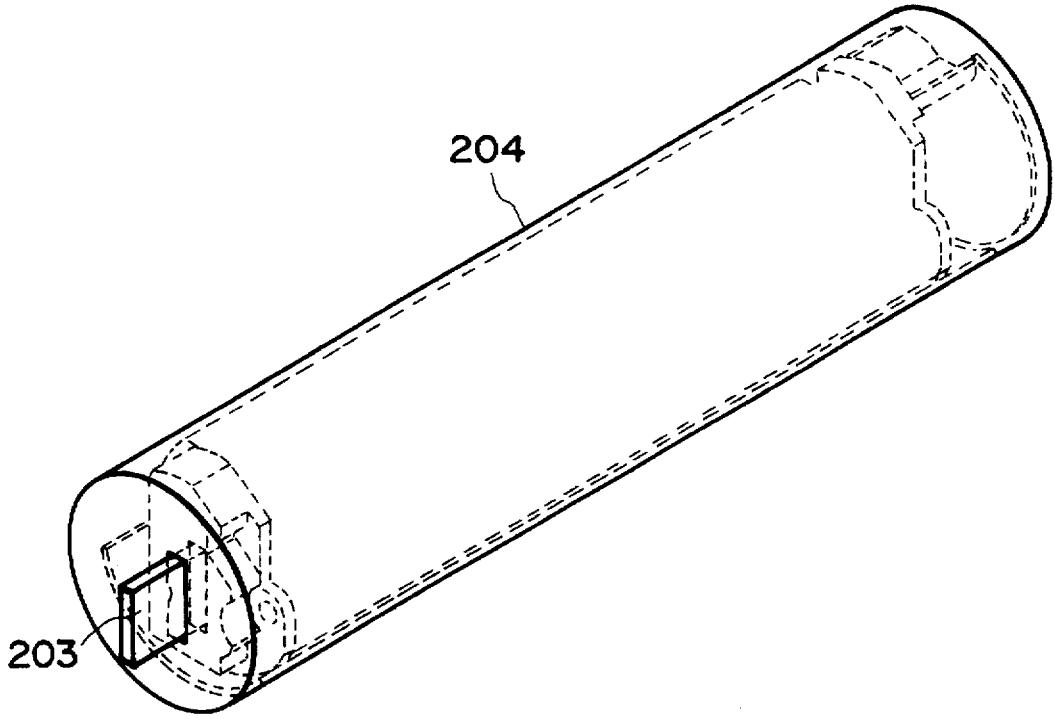
FIG. 9 is a perspective illustration of a developing apparatus according to the first embodiment of the present invention.
Figure 10:
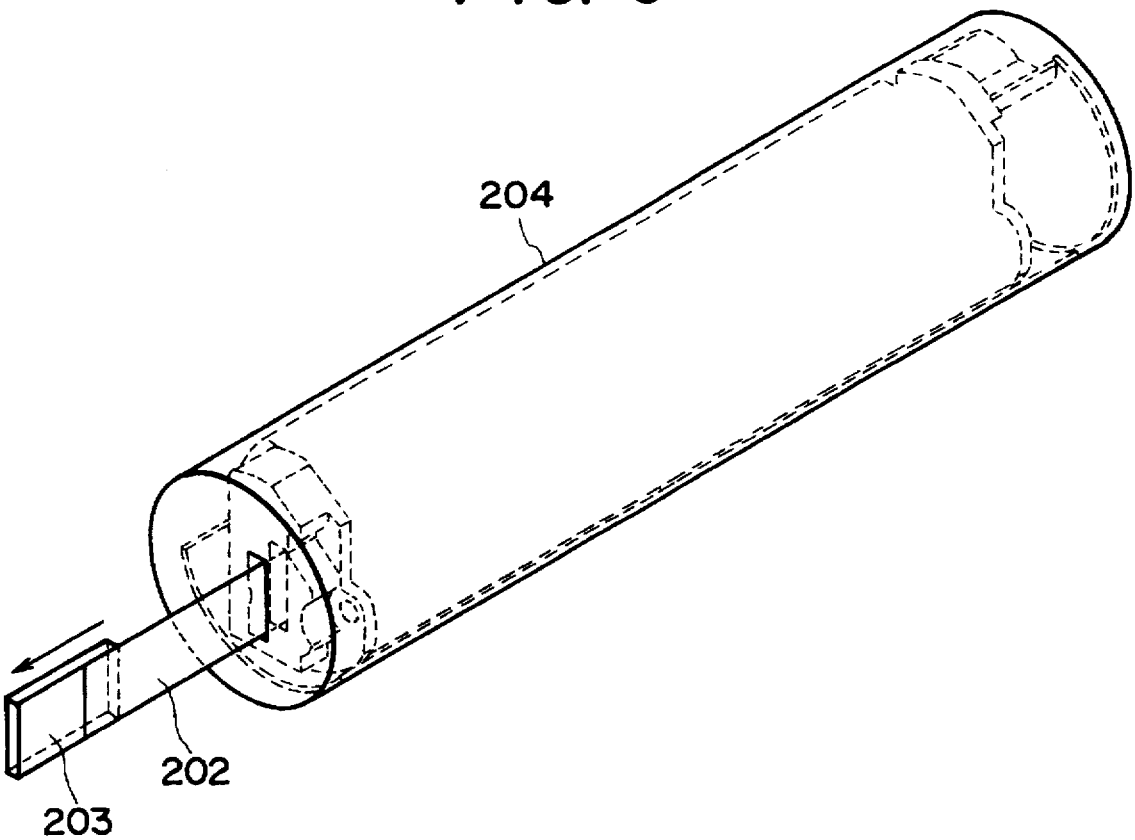
FIG. 10 is a perspective illustration of a manner of withdrawing a seal tape from the developing apparatus shown in FIG. 9.

Referring to FIG. 1, a seal tape 202 is applied so as to confine a toner 205 within a toner vessel 114 and prevent the toner from flowing into a developing chamber 102 in a stage prior to the use of the developing apparatus. This is aimed at preventing unexpected flowing-out from the developing apparatus due to vibration during commercial circulation, etc., of the developing apparatus (or a process cartridge including the same) resulting in soiling with the toner users, the developing apparatus and also the image forming apparatus. The seal tape 202 may be removed by withdrawing in a manner as illustrated in FIGS. 9 and 10 so as to place the developing apparatus in an operable state. FIG. 9 shows a state before use of the developing apparatus wherein the developing apparatus is covered with a cover 204, and a tab 203 connected to the seal tape 202 is exposed from the developing apparatus. In order to make operable the developing apparatus, the tab 203 is pulled to remove the seal tape 202 from the developing apparatus as shown in FIG. 10, thereby allowing the toner vessel 114 and the developing chamber 102 to form a single space. At this time, the toner in the toner vessel 114 can be supplied to the developing chamber.

In a specific example, a non-magnetic monocomponent toner was used for evaluation. The toner supply roller 112 comprised polyurethane foam (of communicating cell-type) having 80 foam cells on its outer surface/per 25 mm in its longitudinal direction and an outer diameter of 16.0 mm (including a urethane layer thickness of 5.5 mm. The developing sleeve 110 had an outer diameter of 16.0 mm to which the supply roller 112 was pressed to provide a pressing depth of 1.5 mm. The supply roller 112 was designed to rotate in the indicated arrow direction at a speed providing a peripheral speed of 64% of the developing sleeve 110 speed. The developing apparatus showed a static torque of 1.0 kgf.cm–1.3 kgf.cm in an ordinary operation. In case of the above structure but with no surface-modifying powder, the developing apparatus showed a static torque of 2.3 kgf.cm and caused a gear slippage at the drive connection part between the main assembly of the image forming apparatus and the developing apparatus. It is assumed that the above phenomenon was caused because a sufficient amount of toner could not be present in the developing chamber 102. Without the rotation of the conveying means 111 and the withdrawal of the seal tape 202 the toner could not flow in a sufficient amount into the developing chamber 102, thus resulting in a large drive torque due to the absence of a sufficient amount of toner in the developing chamber 102.

As a result of image formation by using the above developing apparatus, the resultant images were accompanied with several streaks with no color. Then, the supply roller 112 was caused to carry ca. 8 g of toner 201 supplied to the developing chamber 102, and no other toner was present in the developing chamber 102. The static torque at this time was 1.2 kgf.cm which was ca. ½ of that with no toner application. Further, the occurrence of colorless streaks was prevented.

As described above, by causing the supply roller 112 to carry the toner used, the initial torque of the developing apparatus could be made equal to that during an ordinary use and breakage of the foamed elastic member causing the streak image defect could be avoided. Incidentally, this embodiment has been explained with reference to a non-magnetic mono-component toner, but similar effects could be attained by using a magnetic mono-component toner.

(Second embodiment)

Figure 4:
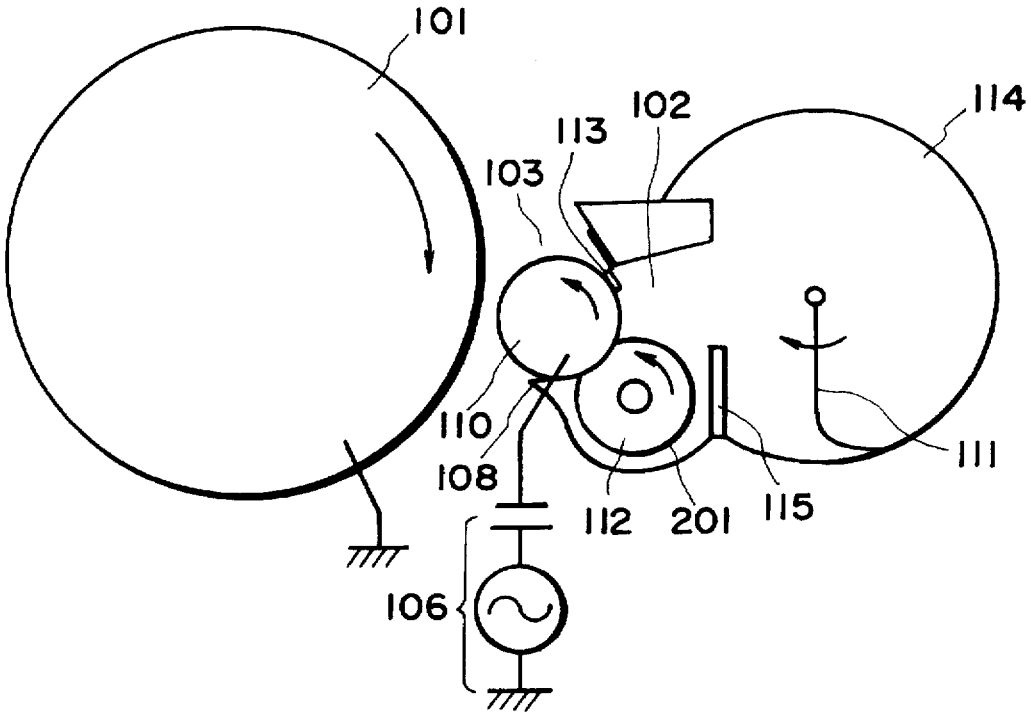
FIGS. 4 and 5 are schematic views for illustrating a second and a fourth embodiment, respectively, of the developing apparatus according to the invention.

FIG. 4 is an enlarged sectional view of members surrounding a developing sleeve in a second embodiment of the developing apparatus according to the present invention, where identical parts as in FIGS. 8 and 1 are denoted by identical reference numerals and detailed description thereof will be omitted.

A supply roller 112 on which a toner 201 is applied may be difficult to handle in some cases because of, e.g., falling off of the applied toner, although it may depend on the amount of the applied toner. Particularly, in the case of mass production of developing apparatus, the operability thereof poses a serious requirement. In this respect, a smaller toner application amount is preferred because of less liability of toner falling, improved operability and less annoyance to the operators. Accordingly, in this embodiment, the application amount of the toner 201 is reduced.

In a specific example, a toner 201 was applied uniformly depending on the number of foam cells on the supply roller 112 from the supply roller outer surface toward the rotation axis. More specifically, when the toner was applied into a thickness of two communicating cells (ca. 0.6 mm) or more, the abrasion of the foam member could be prevented. However, when the toner was applied into a thickness of ca. one cell (ca. 0.3 mm), the abrasion of the foam member occurred although it was slight in degree. This is presumably because the supply roller is abutted against the developing sleeve with a certain pressing depth so that the foam cells in a second layer below the utmost surface layer of the supply roller partially contacts the sleeve to cause an abrasion when a toner of one cell thickness is applied. Further, the static torque was 20 kgf.cm for a one-cell thickness and reduced to 1.5 kgf.cm for a two-cell thickness. A similar test was performed by using a supply roller having 55 cells/25 mm, whereby the abrasion of the foam member could be avoided similarly by applying a toner in a two-cell thickness or larger. Incidentally, in view of the processability, the toner application amount (thickness) should be suppressed to at most the pressing depth or less of the supply roller against the developing sleeve since the toner applied onto the supply roller is liable to be blown out by pressing against the developing sleeve when the supply roller is assembled with the developing sleeve.

(Third embodiment)

In this embodiment, some powder materials used in toner production for controlling chargeability, flowability, environmental stability, etc., of a toner may be used as power to be applied onto the supply roller. These powder materials are less expensive than the toner per se because of unnecessity of a cost occurring in the toner production process. Examples of such powder materials may include: powder of resins, such as polyvinylidene fluoride and polytetrafluoroethylene; powder of aliphatic acid metal salts, such as zinc stearate, calcium stearate, and lead stearate; powder of metal oxides, such as zinc oxide, silica, alumina, titanium oxide, and tin oxide; and surface-treated metal oxide fine powder, such as silica fine powder treated with, e.g., silane coupling agent, titanate coupling agent or silicone oil. However, all these powder materials are not suitable as a surface-modifying powder for a supply roller.

At a time immediately after the initial use of a developing apparatus, the developing chamber surrounding the developing sleeve and the supply roller is filled with a toner supplied from the toner vessel. Then, when the toner is regulated by the developing blade after driving the developing apparatus, the surface-modifying powder applied onto the supply roller is relatively rich compared with the toner on the sleeve and, unless an appropriate balance in chargeability between the powder and the toner is retained, an ununiform toner coating layer is formed or reversal fog is liable to be caused. The powder may preferably be non-chromatic.

In a specific example, a negatively chargeable toner was used, and several powder materials were used as a surface-modifying powder and applied onto the supply roller, including powder A having a positive chargeability, powder B having substantially no chargeability by itself, powder C which was negatively chargeable but showed a weaker chargeability than the toner, and powder D which was negatively chargeable and having a larger chargeability than the toner. The chargeabilities (saturation charges) of the toner and the respective powders were as follows:

Toner: −10 to −30 μC/g

Powder A (surface treated silica): +50 to +100 μC/g

Powder B (styrene-acrylate copolymer resin): 0 to −10 μC/g

Powder C (polyester-polyethylene resin mixture): −10 to −30 μC/g

Powder D (surface treated silica): −80 to −200 μC/g

When each of the above four types of powder was applied onto the supply roller and the developing apparatus was driven, the powder D was strongly electrostatically adsorbed by the developing sleeve, so that the charging of the toner by friction was hindered and a uniform toner layer could not be formed on the sleeve because of lack of a sufficient image force. In the case of using the powder A, the toner and the powder A caused mutual electrostatic adsorption, so that the toner could not be provided with an expected charge, thus causing reversal fog. In the cases of using the powders B and C, respectively, no difficulty was encountered similarly as in the case of applying the toner onto the supply roller.

In a further specific example, powder having a chargeability of −15 μC/g was used in combination with a toner having a chargeability of −10 μC/g, whereby no difficulty was encountered similarly as in the case of application of the toner onto the supply roller. Further, in case of applying powder having a chargeability of −29 μC/g onto the supply roller for use in combination with a toner having a chargeability of −18 μC/g, no difficulty was encountered either. This is because powder having a chargeability identical to that of the toner, i.e., a chargeable up to ca. 50% larger than that of the toner, does not remarkably hinder the chargeability of the toner whereas a powder (like powder D) having an excessively larger chargeability than the toner does.

(Fourth embodiment)

Figure 5:
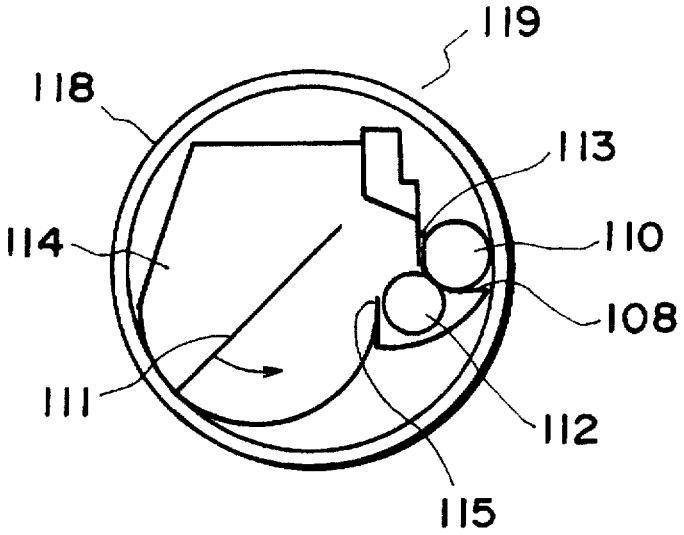
Figure 6:
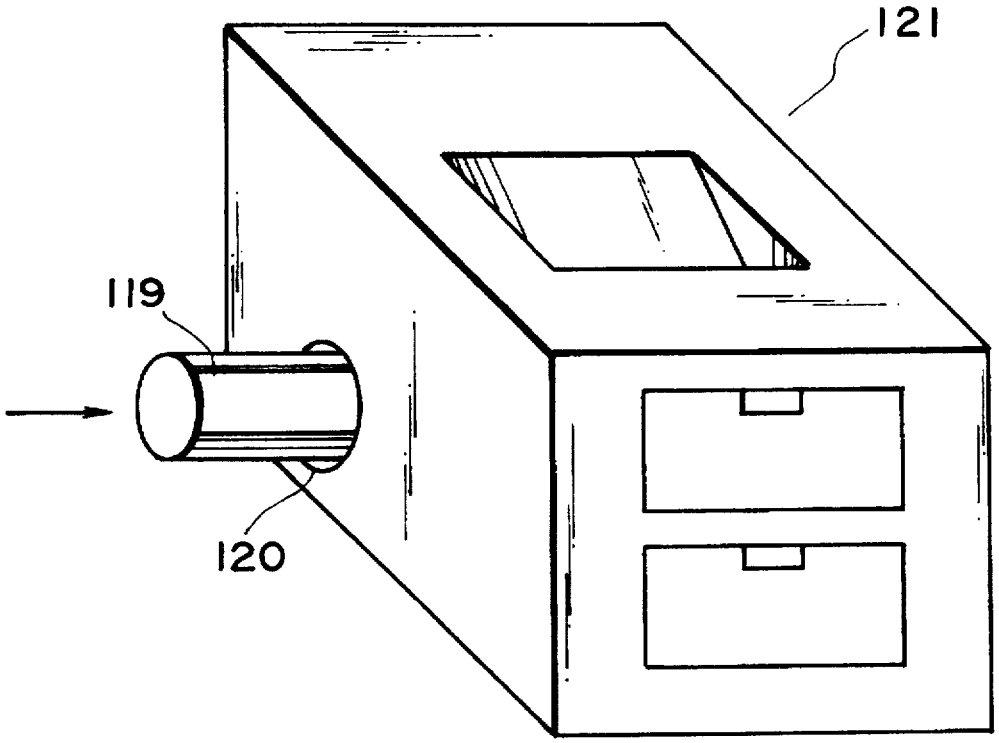
FIG. 6 is a schematic view for illustrating a manner of incorporating a process cartridge including the fourth embodiment of the developing apparatus into a main assembly of image forming apparatus.

FIGS. 4, 5 and 6 illustrate an embodiment of a process cartridge to be incorporated in an image forming apparatus, wherein the developing sleeve supply roller and related members already described with reference to the preceding figures are denoted by identical numerals and detailed description thereof will be omitted.

FIG. 5 illustrates a process cartridge detachably attachable to an image forming apparatus main assembly, including a developing apparatus according to the present invention. More specifically, such a developing apparatus is enclosed within a cartridge cover 118 to form a process cartridge 119. The cartridge life may be represented by a time until which the toner within the toner vessel 114 is used up, when a new process cartridge is put in service in exchange therefor to again allow an image formation, whereby a troublesome operation, such as toner replenishment, can be unnecessitated. The process cartridge 119 is so formed as to be detachably mountable to a main assembly 121 by insertion into a cartridge insertion port 120 provided in the main assembly 121 as shown in FIG. 6.

Figure 7:
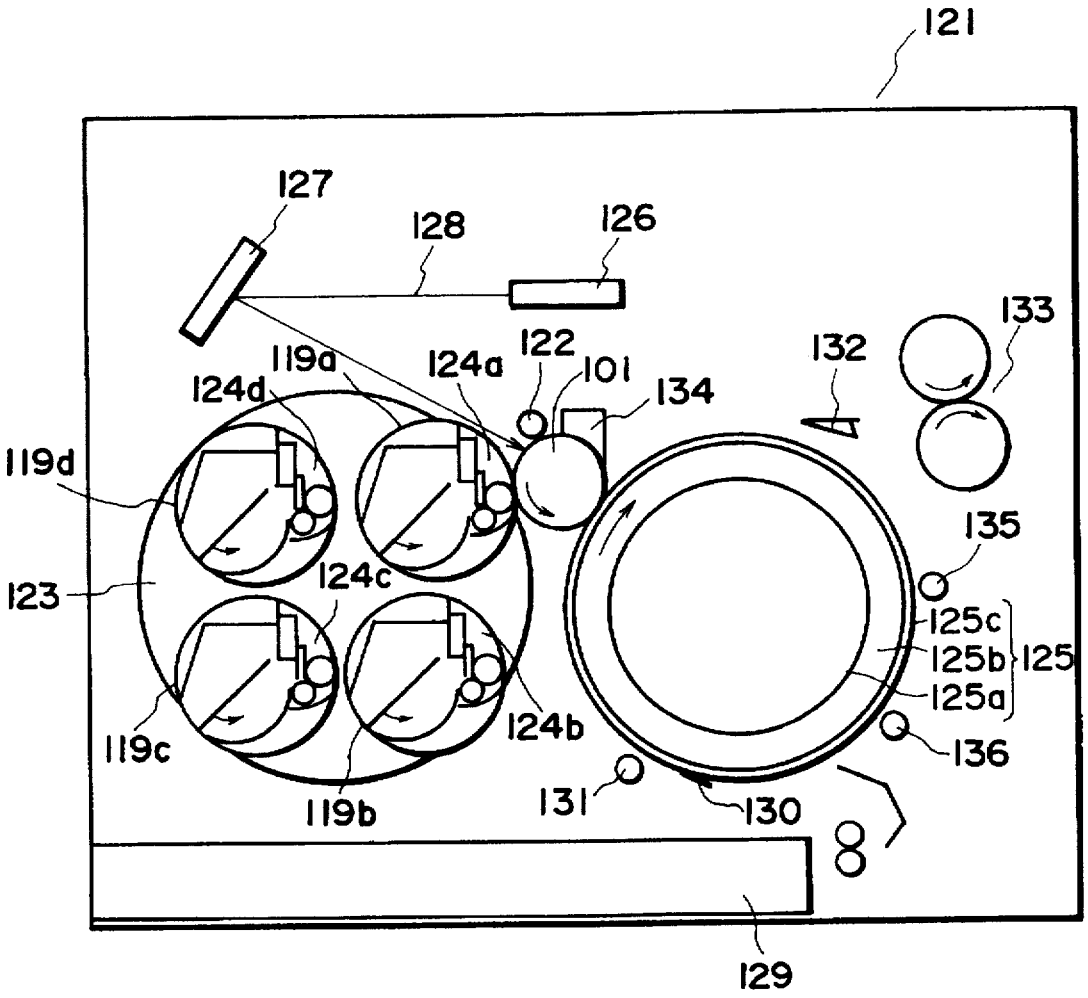
FIG. 7 is a schematic illustration of a full-color image forming apparatus including developing apparatus according to the fourth embodiment of the invention.

Referring to FIG. 7, an image forming apparatus including such a process cartridge including a developing apparatus according to this embodiment and an image forming process using the apparatus will now be described. The image forming apparatus shown in FIG. 7 is an apparatus capable of effecting full-color image formation by including four process cartridges 119 as described above respectively containing different colors of toners. By using such an image forming apparatus, a cycle of forming a recorded image on an image-bearing member through charging, exposure and development and transferring the recorded image onto a recording paper is repeated several times (four times in the case of FIG. 7) to form a color image comprising a superposition of plural color images on the recording sheet.

FIG. 7 is a sectional view of a color image forming apparatus according to this embodiment. As shown in FIG. 7, the apparatus includes therein a photosensitive drum 101 as an image-bearing member, a roller charger 122, and a rotatable supporting member 123 disposed on the left side of the photosensitive drum and detachably mounted with plural process cartridges 119*a*, 119*b*, 119*c* and 119*d*, which are carried in positions around a central rotation axis of the supporting member so as to have their developing openings 124*a*–124*d* directed toward the photosensitive drum 101 when they are placed in a developing position facing the photosensitive drum 101. The respective process cartridges 119*a*–119*d* contain a magenta toner, a cyan toner, a yellow toner and an black toner, respectively. The developing sleeve 110 in each process cartridge is designed to rotate at a peripheral speed which is 1.75 times that of the photosensitive drum 101. The process cartridges 119*a*–119*d* are driven so that their developing openings 124*a*–124*d* are always directed to the photosensitive drum 101 surface as shown in FIG. 7. An example of such a drive method is described in detail in Japanese Laid-Open Patent Application (JP-A) 50-93437.

On a right side of the photosensitive drum 101, there is disposed a transfer drum 125 carrying a transfer paper (not shown) onto which a toner image formed on the photosensitive drum 101 is repetitively transferred. According to the above structure, the photosensitive drum 101 is rotated in an indicated arrow direction at a peripheral speed of 100 mm/sec by a drive means (not shown). The photosensitive drum 101 is composed of a 40 mm-dia. aluminum cylinder of which the outer surface is coated with a photoconductor of OPC (organic photoconductor) but may be coated with A—Si (amorphous silicon), CdS or Se, alternatively.

An upper portion of the entire apparatus includes an exposure apparatus composed of an optical unit 126 including a laser diode, a rotating polygonal mirror rotated by a high-speed motor and lenses, and a deflection mirror 127. The charging roller 122 is supplied with a DC voltage of −700 volts and an AC voltage of AC frequency of 1000 Hz and Vpp (peak-to-peak voltage) of 1800 volts in superposition to be charged uniformly at about −700 volts. When image signal is inputted to the optical unit 126, a laser beam issued from the laser diode is incident to the photosensitive drum 101 via an optical path 128. The thus-exposed portion on the photosensitive drum assumes ca. −100 volts. The photosensitive drum 101 carrying the thus-formed electrostatic latent image rotates in an indicated arrow direction to be developed by any one of the process cartridges 119*a*–119*d*.

Then, a transfer step is performed as follows. The transfer drum 125 comprises a 155 mm-dia. metal cylinder 125*a*, about which a 5 mm-thick elastic layer 125*b* and a 100 μm-thick polyvinylidene fluoride layer 125*c* are wound in this order. The elastic layer 125*b* is composed of foam urethane. The transfer drum 125 is rotated in an indicated arrow direction by a drive means (not shown) at a peripheral speed of 100 mm/sec equal to that of the photosensitive drum 101. A tip of a transfer sheet supplied from a transfer sheet cassette 129 by a pickup roller (not shown) is held by a gripper 130, and the transfer sheet is electrostatically adsorbed onto the transfer drum 125 by an adsorption roller 131. The toner image on the photosensitive drum 101 is transferred onto such a transfer sheet adsorbed on the transfer drum 125 under the action of a voltage applied to the transfer drum from a power supply (not shown). The above transfer step is repeated four times for magenta color, cyan color, yellow color and black color, respectively, to form four color toner image layers on the transfer sheet. After the transfer step for the final color, the transfer sheet is separated from the transfer drum 125 by a separation claw 132 and then sent to a known hot-pressure fixing device 133 where the toner image layers are melt-fixed onto the transfer sheet to form a color image. It is also possible to adopt an intermediate transfer member on which toner images are repeatedly transferred and then finally transferred onto a transfer sheet, or adopt a process including multiple development steps wherein multi-color toner images are formed on a photosensitive drum and then transferred onto a transfer sheet.

The residual toner on the photosensitive drum 101 is cleaned by a known cleaning device 134, such as a fur brush or a blade means. The photosensitive drum 101 is then initialized by charge-removal using a discharging means. In this embodiment, the photosensitive drum 101 is charged by the charging roller 122. The charge-removal of the photosensitive drum 101 may be effected by changing the DC voltage to substantially 0 volt while retaining the AC voltage for the charging. It is preferred that the toner on the transfer drum 125 is cleaned, as desired, by using a transfer drum cleaning device 135 including fur brush or web. The transfer drum 125 may be charge-removed for initialization by applying a voltage supplied to a charge-removal roller 136 from a power supply (not shown).

In the above-mentioned embodiment, it is most preferred to apply to the supply roller 112 a surface-modifying powder having a color identical to that of the toner used in each developing apparatus. This, however, results in a higher production cost because it requires a step and an apparatus for applying such a powder for each color. Accordingly, in this embodiment, a color of toner having the highest brightness among the toners used is commonly applied to the supply rollers 112 for the developing apparatus of all colors. For example, when magenta, cyan, yellow and black toners are used, yellow powder having the highest brightness is used for all the developing apparatus. In an actual example, all the color images could be formed without substantial change in hue. On the other hand, in a case of applying black color powder as a surface-modifying powder onto the supply rollers in all the developing apparatus, only somber or dark images could be formed in the resultant magenta and cyan images, and the yellow images failed in color reproduction. In case where a magenta or cyan powder was used as a surface-modifying powder for all the developing apparatus, no difficulty was encountered in black image formation but the resultant yellow image became reddish or bluish, thus failing to effect good color reproduction.

As described above, by using a color powder having the highest brightness among the toners used as a surface-modifying powder to be applied onto a supply roller in all the developing apparatus, it becomes possible to reduce the production cost without incurring a difficulty in the initial stage of color formation. Incidentally, it is more effective to use a non-chromatic (toner) powder containing no colorant as the surface-modifying powder in order to best obviate an adverse effect to color reproducibility. The brightness of toners referred to in this embodiment are based on values measured by using a spectral colorimeter ("938", available from X-Rite Co.).

(Fifth embodiment)

Figure 11:
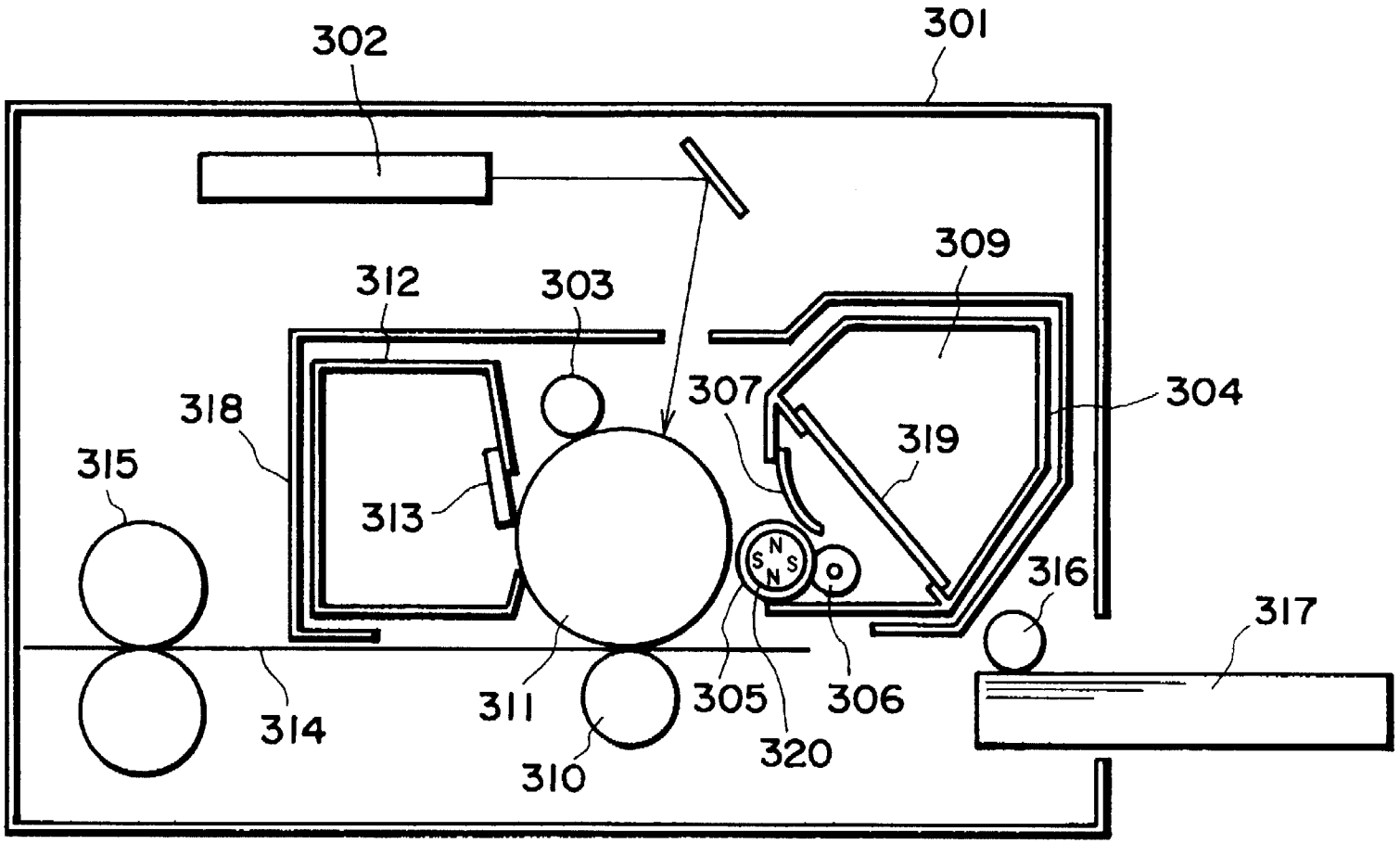
FIG. 11 is a schematic view for illustrating a fifth embodiment of the invention.

FIG. 11 illustrates an image forming apparatus including another embodiment of process cartridge and developing apparatus according to the present invention. Referring to the figure, the image forming apparatus 301 includes a process cartridge 318 which is detachably mounted to the main assembly of the apparatus 301 and in turn integrally includes a photosensitive drum 311, a charging member 303 and a cleaning member 313, etc., in addition to a developing apparatus 304 according to an embodiment of the present invention. As shown in FIG. 11, the developing apparatus 304, the photosensitive drum 311, the charging member 303 and a cleaning device 312 having the cleaning blade 313 are included in a process cartridge cover to form a cartridge 318. The cartridge life may be represented by a time until which the toner within the toner vessel 309 is used up, when a new process cartridge is in service in exchange therefor to again allow a fresh image formation, whereby a troublesome operation, such as toner replenishment, can be eliminated.

In this embodiment, a magnetic mono-component toner is used. A magnetic toner can be supplied to a developing sleeve by utilizing a magnetic force exerted by a magnet disposed within the developing sleeve and accordingly does not require a supply roller 306 as shown in FIG. 11 only from a viewpoint of toner supply. However, in these days requiring a high resolution and a clarity of image, it is essentially required to form a thin toner layer for improving the chargeability and uniform charge of toner. For this reason, it has been practiced to dispose an elastic blade 307 of a rubber or metal abutted against a developing sleeve 305 so as to regulate the toner passing through the abutting position between the elastic blade 307 and the developing sleeve 305, thereby forming a thin toner layer on the developing sleeve and provide the toner with a sufficient charge by friction at the abutting position. This is effective in providing an improvement in resolution and clarity. However, as a result, the residual toner on the developing sleeve after development can have different states between the image portion and non-image portion and the history thereof can be reflected in a subsequently formed image, i.e., a so-called sleeve ghost. Further, after continuous use of the developing apparatus for a long period, the toner on the developing sleeve can be excessively charged, i.e., causing so-called "charge-up". This tendency becomes noticeable particularly in a low-humidity environment. For avoiding these difficulties, in this embodiment, a supply roller 306 is disposed in abutment to the developing sleeve 305 for removing the residual toner on the developing sleeve and stably supplying the toner in the toner vessel to the developing sleeve.

Image formation in this embodiment may be effected by using the apparatus shown in FIG. 11 as follows. Referring to FIG. 11, the image forming apparatus 301 includes a cylindrical photosensitive drum 311 as a latent image-bearing member, which rotates in one direction about its axis. The surface of the photosensitive drum 311 is uniformly charged by a charging device 303 and then exposed to image light from an exposure device 302 to form a latent image thereon. The developing apparatus 304 is in the form of a hopper for storing the toner equipped with the developing sleeve 305 as a developer-carrying member and supplies the toner onto the latent image on the photosensitive drum 311 to visualize the image. In proximity to the developing sleeve 305, there are disposed a developing blade 307 as a developer-regulating member, and a supply roller 306 for conveying and supplying the toner to the developing sleeve 305 and scraping the development residual toner on the developing sleeve 305. Further, a bias voltage supply (not shown) is disposed between the photosensitive drum 311 and the developing sleeve 305 so as to apply an appropriate bias voltage comprising a DC bias voltage and an AC bias voltage in superposition. The toner image thus formed on the photosensitive drum 311 is transferred onto a transfer sheet 314 by a transfer device 310. The transfer sheet 314 is supplied from a paper cassette 317 via a paper supply roller 316 to the transfer device 310 while being synchronized with the image on the photosensitive drum 311 by a registering roller (not shown). The toner image transferred to the transfer sheet 314 is sent together with the transfer sheet 314 to a fixing device 315, where the toner image is fixed onto the transfer sheet under application of heat and/or pressure to form a recorded image. On the other hand, the toner remaining on the photosensitive drum 311 without being transferred after the transfer step is removed by the cleaning blade 313 of the cleaning device 312. Thereafter, the photosensitive drum surface is charged by the charger 303 to repeat the above-mentioned image forming cycle.

In this embodiment in the form of a process cartridge 318 including a developing apparatus, a seal tape 319 is disposed to partition the toner vessel 309 and the developing chamber, thereby aiming at prevention of unexpected toner leakage due to vibration during commercial circulation, etc. When the seal tape 319 is removed to supply the toner to the developing chamber, the supply roller 306 is abutted to the developing sleeve 305 with a certain nip, into which the toner is not allowed to enter. In this instance, if the supply roller 306 is continually and directly abutted to the developing sleeve 305, a portion of the outer surface of the supply roller 306 can be torn to form a toner fragment or provide an increased initial torque of the developing apparatus accompanied with a rubbing between the supply roller 306 and the developing sleeve 305. Particularly, in case where drive power supply is performed through a single communication mechanism, the drive power has to include the torque for the photosensitive drum in addition to the torque for the developing apparatus, so that the increase in torque for the developing apparatus not only promotes the formation of a toner fragment but also is liable to cause a serious trouble, such as breakage of the developing apparatus drive mechanism, the process cartridge drive mechanism or even the drive mechanism of the entire image forming apparatus.

Accordingly, in this embodiment, the outer surface of the supply roller is uniformly coated in advance with the toner used so as to prevent the direct abutment between the developing sleeve 305 and the supply roller 306. As a result, it becomes possible to prevent the torque increase at the time of initial use of a process cartridge and to prevent the formation of a torn fragment from the supply roller.

In the above, the surface-modifying powder has been described to be formed by the toner used in the developing apparatus, but similar effects can be performed by coating the outer surface of the supply roller with powder having substantially no chargeability or a chargeability of a polarity equal to that of the toner and a magnitude in terms of an absolute value equal to or smaller than that of the toner. Examples of such powder may include powder materials used for controlling the chargeability, flowability, environmental stability, etc., of the toner.

What is claimed is:

1. A developing apparatus, comprising:

a developing chamber for containing a developer;

a developer-carrying member for carrying and conveying the developer to a developing region; and a developer-supplying member abutted rotatably to the developer-carrying member;

wherein said developer-supplying member has a powder at least at its surface, the powder having substantially no chargeability or a chargeability of a same polarity as the developer, an absolute value of said chargeability of the same polarity being equal to or smaller than that of the developer.

2. A developing apparatus according to claim 1, wherein said powder comprises the developer.

3. A developing apparatus according to claim 1, wherein said powder comprises metal oxide.

4. A developing apparatus according to claim 1, wherein said powder comprises non-chromatic powder or a developer of a brightest color among a plurality of developers to be used.

5. A developing apparatus according to claim 1, wherein said developer-supplying member comprises a foamed elastic roller.

6. A developing apparatus according to claim 1, wherein said developer is a mono-component developer.

7. A developing apparatus according to claim 5, wherein said developer is a mono-component developer.

8. A process cartridge detachably mountable to a main assembly of an image forming apparatus, including at least a developing apparatus; wherein said developing apparatus comprises a developing chamber for containing a developer, a developer-carrying member for carrying and conveying the developer to a developing region, and a developer-supplying member abutted rotatably to the developer-carrying member; wherein said developer-supplying member has powder at at least its surface, said powder having substantially no chargeability or having a chargeability of a same polarity as the developer, an absolute value of said chargeability of the same polarity being equal to or smaller than that of the developer.

* * * * *

UNITED STATES PATENT AND TRADEMARK OFFICE

CERTIFICATE OF CORRECTION

PATENT NO. : 5,697,028

DATED : December 9, 1997

INVENTOR(S) : KOBAYASHI et al.

It is certified that error appears in the above-identified patent and that said Letters Patent is hereby corrected as shown below:

Column 2

Line 60, "magnitude" should read --magnitude,--.

Column 7

Line 8, "power" should read --powder--.

Column 12

Line 61, "at least" should read --least at--.

Signed and Sealed this

Fourteenth Day of July, 1998

Bruce Lehman

*Attest:*

BRUCE LEHMAN

*Attesting Officer*

*Commissioner of Patents and Trademarks*

US005697028C1

(12) EX PARTE REEXAMINATION CERTIFICATE (4867th)

United States Patent

Kobayashi et al.

(10) Number: US 5,697,028 C1

(45) Certificate Issued: Oct. 21, 2003

(54) DEVELOPER-SUPPLYING ROLLER HAVING A SURFACE-MODIFYING POWDER

(75) Inventors: Tetsuya Kobayashi, Numazu (JP); Hiroshi Sasame, Numazu (JP); Tatsuhiko Hayakawa, Mishima (JP); Naoki Enomoto, Susomo (JP); Yoshiro Saito, Numazu (JP)

(73) Assignee: Canon Kabushiki Kaisha, Tokyo (JP)

Reexamination Request:
No. 90/006,447, Nov. 8, 2002

Reexamination Certificate for:

| | |
|---|---|
| Patent No.: | **5,697,028** |
| Issued: | **Dec. 9, 1997** |
| Appl. No.: | **08/575,130** |
| Filed: | **Dec. 19, 1995** |

Certificate of Correction issued Jul. 14, 1998.

(30) Foreign Application Priority Data

Dec. 21, 1994 (JP) ..... 6-318287
May 23, 1995 (JP) ..... 7-123902

(51) Int. Cl.[7] ..... G03G 15/08

(52) U.S. Cl. ..... 399/381; 399/111; 399/119

(58) Field of Search ..... 399/111, 119, 399/252, 272, 279, 281, 286; 118/651, 656, 657, 658; 492/18, 30, 37, 56

(56) References Cited

U.S. PATENT DOCUMENTS

| | | | | |
|---|---|---|---|---|
| 4,930,438 A | * | 6/1990 | Demizu et al. | 118/651 |
| 5,287,150 A | * | 2/1994 | Kinoshita et al. | 399/281 |
| 5,594,198 A | * | 1/1997 | Ikeda et al. | 399/281 |

FOREIGN PATENT DOCUMENTS

| | | |
|---|---|---|
| JP | 2-54288 | 2/1990 |
| JP | 2-298971 | 12/1990 |
| JP | 5-158335 | 6/1993 |

* cited by examiner

*Primary Examiner*—Hoan Tran

(57) ABSTRACT

A developing apparatus is provided which includes a developing chamber for containing a developer, a developer-carrying member for carrying and conveying the developer to a developing region, and a developer-supplying member abutted rotatably to the developer-carrying member. The developer-supplying member has surface-modifying powder at least at its surface. The powder has substantially no chargeability or a chargeability of a polarity equal to that of the developer and a magnitude in terms of absolute value equal to or smaller than that of the developer. By application of the surface-modifying powder, the developing apparatus can obviate a partial testing of a surface portion of the developer-supplying member which leads to image defects and an increase in drive torque at the initial drive thereof.

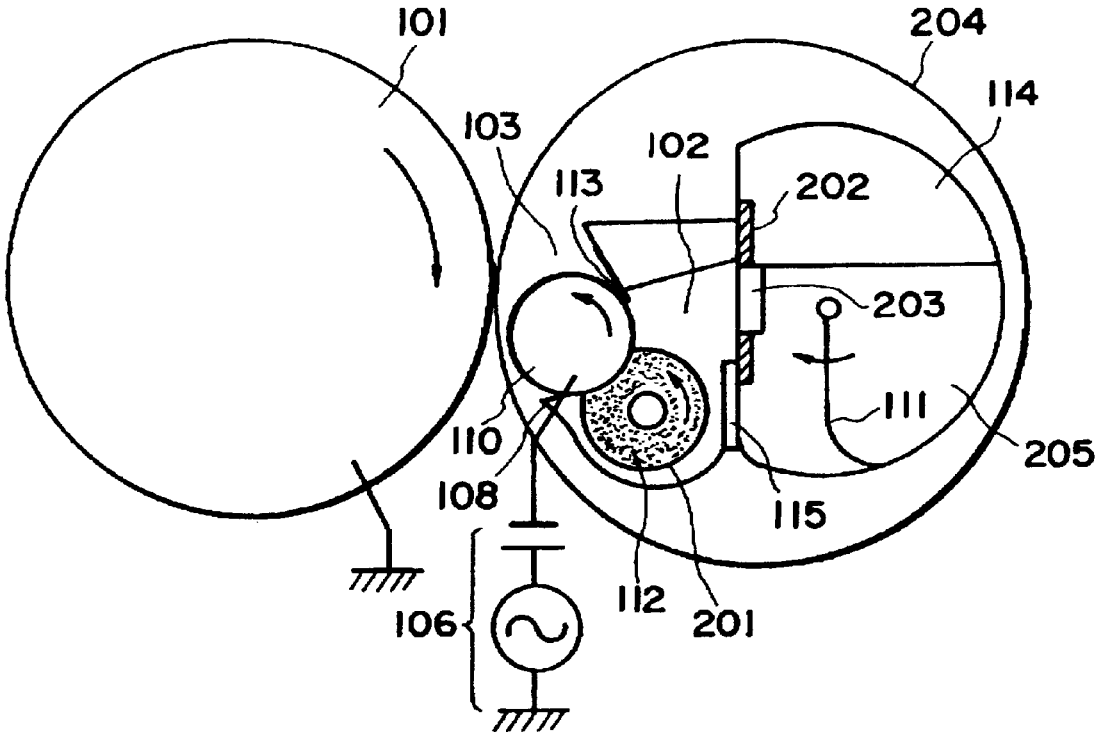

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 8 are determined to be patentable as amended.

Claims 2–7, dependent on an amended claim, are determined to be patentable.

New claims 9–25 are added and determined to be patentable.

1. A developing apparatus, comprising:

a developing chamber for containing a developer;

a developer-carrying member for carrying and conveying the developer to a developing region; and a developer-supplying member abutted rotatably to [the] *said* developer-carrying member;

wherein said developer-supplying member [has] *includes* a powder *directly provided* at least at [its] *a* surface *thereof prior to a first operational use of said developing apparatus*, the powder having substantially no chargeability or a chargeability of a same polarity as the developer, *and* an absolute value of said chargeability of the same polarity being equal to or smaller than that of the developer.

8. A process cartridge detachably mountable to a main assembly of an image forming apparatus, including at least a developing apparatus[;], wherein said developing apparatus comprises a developing chamber for containing a developer, a developer-carrying member for carrying and conveying the developer to a developing region, and a developer-supplying member abutted rotatably to [the] *said* developer-carrying member; wherein said developer-supplying member [has] *includes a* powder *directly provided* at least at [its] *a* surface *thereof prior to a first operational use of said developing apparatus*, said powder having substantially no chargeability or having a chargeability of a same polarity as the developer, *and* an absolute value of said chargeability of the same polarity being equal to or smaller than that of the developer.

*9. A developing apparatus according to claim 1, wherein the developer comprises a non-magnetic toner.*

*10. A developing apparatus according to claim 1, wherein said developer-carrying member and said developer-supplying member rotate in the same direction.*

*11. A developing apparatus according to claim 1, wherein said powder is a yellow powder.*

*12. A process cartridge according to claim 8, wherein said powder is a yellow powder.*

*13. A developing apparatus, comprising:*

*a developer vessel containing a developer therein;*

*a developing chamber for receiving the developer from said developer vessel and containing the received developer therein;*

*a developer-carrying member for carrying and conveying the received developer in said developing chamber; and*

*a developer-supplying member disposed within said developing chamber, said developer-supplying member including an outer surface layer that comprises a plurality of open foam cells, and said developer-supplying member being abutted rotatably to said developer-carrying member for supplying the received developer in said developing chamber onto said developer-carrying member;*

*wherein said developer-supplying member is directly provided with a powder at least at said outer surface thereof prior to a first operational use of said developing apparatus, said powder having substantially no chargeability or a chargeability of a same polarity as a polarity of a chargeability of the developer, and an absolute value of the chargeability of the same polarity being equal to or less than the chargeability of the developer.*

*14. A developing apparatus according to claim 13, further comprising a seal for separating said developer vessel and said developing chamber and allowing a supply of the developer to be provided from said developer vessel to said developing chamber by removal of said seal prior to the first operational use of said developing apparatus.*

*15. A developing apparatus according to claim 13, wherein said developer-carrying member and said developer-supplying member rotate in the same direction.*

*16. A developing apparatus according to claim 13, wherein the developer comprises a non-magnetic toner.*

*17. A developing apparatus according to claim 13, wherein said powder is a yellow powder.*

*18. A developing apparatus according to claim 17, wherein said developer-carrying member and said developer-supplying member rotate in the same direction.*

*19. A process cartridge detachably mountable to a main assembly of an image forming apparatus, said process cartridge including at least a developing apparatus, wherein said developing apparatus comprises a developer vessel containing a developer therein; a developing chamber for receiving the developer from said developer vessel and containing the received developer therein; a developer-carrying member for carrying and conveying the received developer in said developing chamber; and a developer-supplying member disposed within said developing chamber, said developer-supplying member including an outer surface layer that comprises a plurality of open foam cells, and said developer-supplying member being abutted rotatably to said developer-carrying member for supplying the received developer in said developing chamber onto said developer-carrying member;*

*wherein said developer-supplying member is directly provided with a powder at least at said outer surface thereof prior to a first operational use of said developing apparatus, said powder having substantially no chargeability or a chargeability of a same polarity as a polarity of a chargeability of the developer, and an absolute value of the chargeability of the same polarity being equal to or less than the chargeability of the developer.*

*20. A process cartridge according to claim 19, further comprising a seal for separating said developer vessel and said developing chamber and allowing a supply of the developer to be provided from said developer vessel to said developing chamber by removal of said seal prior to the first operational use of said developing apparatus.*

*21. A process cartridge according to claim 19, wherein the developer comprises a non-magnetic toner.*

*22. A process cartridge according to claim 19, wherein said developer-carrying member and said developer-supplying member rotate in the same direction.*

*23. A process cartridge according to claim 19, wherein said powder is a yellow powder.*

*24. A developing apparatus according to claim 13, wherein said outer surface layer comprises a communicating cell-type foam.*

*25. A process cartridge according to claim 19, wherein said outer surface layer comprises a communicating cell-type foam.*

* * * * *